US007118390B2

(12) United States Patent
Kita

(10) Patent No.: US 7,118,390 B2
(45) Date of Patent: Oct. 10, 2006

(54) ELECTRIC JUNCTION BOX

(75) Inventor: Yukinori Kita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 11/249,498

(22) Filed: Oct. 14, 2005

(65) Prior Publication Data

US 2006/0084294 A1 Apr. 20, 2006

(30) Foreign Application Priority Data

Oct. 15, 2004 (JP) ..... 2004-301793

(51) Int. Cl.
*H01R 12/00* (2006.01)

(52) U.S. Cl. ..... 439/76.2; 439/949

(58) Field of Classification Search ..... 439/76.1, 439/76.2, 752, 949

See application file for complete search history.

(56) References Cited

U.S. PATENT DOCUMENTS 4,135,226 A * 1/1979 Kourimsky ..... 361/796
4,603,930 A * 8/1986 Ito ..... 439/78
4,703,397 A * 10/1987 Minoura et al. ..... 361/826
6,875,028 B1 4/2005 Kita et al.
6,887,084 B1 * 5/2005 Saito et al. ..... 439/76.2
6,905,347 B1 * 6/2005 Kobayashi ..... 439/76.2
6,922,332 B1 * 7/2005 Naimi et al. ..... 361/641

FOREIGN PATENT DOCUMENTS

JP 2001-025137 1/2001

OTHER PUBLICATIONS

English Language Abstract of JP 2001-025137.
U.S. Appl. No. 11/231,997 to KITA, filed on Sep. 22, 2005.

* cited by examiner

*Primary Examiner*—Khiem Nguyen
(74) *Attorney, Agent, or Firm*—Greenblum & Bernstein, P.L.C.

(57) ABSTRACT

An electric junction box having a simple configuration that can prevent a terminal from being pulled down. In an upper connector attached to a fuse box, terminal holders are provided so as to support relay portions of bus bar terminals from the front. Such a structure provides a simple configuration that can prevent the bus bar terminals from being pulled down when being received into and removed from an opposite connector. The relay portions are clamped between rear end edges of the terminal holders and rear walls of connectors. Such a configuration completely controls movement of the relay portions along the fitting direction to the opposite connector, thus reliably preventing displacement of the bus bar terminals.

20 Claims, 4 Drawing Sheets

ELECTRIC JUNCTION BOX

CROSS REFERENCE TO RELATED APPLICATIONS

The present disclosure relates to subject matter contained in priority Japanese Application No. 2004-301793, filed on Oct. 15, 2004, which is herein expressly incorporated by reference in its entirety.

BACKGROUND OF THE INVENTION

1. Field of the Invention

The present invention relates to an electric junction box and more particularly to an electric junction box including a terminal holder configured to provide support to a bus bar terminal of the electric junction box.

2. Description of Related Art

The prior art, such as Japanese Patent Laid Open Publication 2001-25137, discloses an electric junction box used for distributing electric power from a vehicle power source to various electrical components. In the electric junction box of the prior art, the electric junction box has control elements and switching elements mounted on one surface of a circuit board and a circuit component mounted on the other surface of the circuit board within a water-proof case. The bus bar is adhered to the circuit component through an insulating layer. The bus bar board is electrically connected to the switching elements forming an electrical circuit.

Some prior art electric junction boxes include a case having a hood shaped connector that accommodates a bus bar terminal inside. In the aforementioned prior art electric junction boxes, the bus bar terminal is provided at an end of the bus bar. Further, an opposite connector is received into the connector and provided on an end of an electric wire connected to a power source, an alternator or similar device. An opposite terminal received by the opposite connector is configured to be electrically connected to an end of the bus bar terminal.

In cases where the height of a bus bar board differs from the height of a connector, or the bus bar terminal extends in a direction from the bus bar board that differs from a receiving direction of the bus bar terminal to an opposite connector; the bus bar terminal is required to be cranked or folded by bending in order to be received by the connector. When the bus bar terminal is repeatedly received by and removed from the opposite connector an end of the bus bar terminal is pulled due to frictional engagement with the opposite connector. As a result, a bending portion of the bus bar terminal may be deformed near its end.

The bus bar terminal can be prevented from being pulled down and deformed by fixing a locking piece to the bus bar terminal. In the aforementioned configuration the locking piece is configured to elastically fix the bus bar terminal from an inner peripheral surface of the connector.

The construction of the prior art described above, however, has the disadvantage of requiring the additional labor of configuring the locking piece to engage the bus bar terminal in an assembling process and also complicates the housing structure, resulting in increased costs.

SUMMARY OF THE INVENTION

The present invention is provided to address the above described problems and problems in the prior art. An object of the present invention is to provide an electric junction box having a simple construction that prevents a terminal from being pulled down or deformed.

An aspect of the present invention provides an electric junction box that includes a circuit component having a bus bar board and a case housing the circuit component. The electric junction box includes a first housing unit, a bus bar terminal and a second housing unit. The first housing unit includes a receiving portion provided in the case, configured to engage an opposite connector. The bus bar terminal includes a relay portion and a connecting portion, with the relay portion being mounted on the bus bar board. The relay portion is received by a receiving portion and extends in a direction transverse to a receiving direction. The connecting portion extends from an end of the relay portion along the receiving direction and is configured to be electrically connected to an opposite terminal provided in an opposite connector. The second housing unit includes a terminal holder configured for attachment to the first housing unit and to support the relay portion from a side opposite the receiving direction.

Another aspect of the present invention provides the electric junction box with a relay portion extending along a back wall of the receiving portion. Further, the terminal holder clamps the relay portion against the back wall of the receiving portion thereby supporting the relay portion therebetween.

Another aspect of the invention provides the electric junction box with a terminal holder that extends substantially the entire width of the bus bar terminal.

Another aspect of the invention provides the electric junction box with a terminal holder to support the bus bar terminal. The bus bar terminal includes a base terminal portion and connecting portion. The base terminal portion is connected to the bus bar board, and the connecting portion extends outwardly beyond the base terminal portion in a direction of the width of the bus bar board.

In another aspect of the invention the terminal holder is provided in a second housing unit and is configured to support the relay portion from a side opposite the receiving direction. The second housing unit is configured for attachment to the first housing unit; thereby providing a simple configuration that can prevent the bus bar terminal from being pulled down.

According to the present invention the terminal holder clamps the relay portion against the back wall of the receiving portion and supports the relay portion therebetween. This construction allows for movement along a receiving direction of the relay portion from the first housing unit to the opposite connector to be controlled; thereby making it possible to reliably prevent the bus bar terminal from being pulled down or deformed.

According to the present invention the terminal holder extends substantially the entire width of the bus bar terminal in order to provide support. Such a configuration allows the terminal holder to support the bus bar terminal evenly along the direction of its width, thereby avoiding deformation of the bus bar terminal.

According to the present invention the terminal holder is configured to engage the bus bar terminal, which includes a base terminal portion and a connecting portion. The base terminal portion is connected to the bus bar board and the connecting portion extends outwardly beyond the base terminal portion in a dirctection of the width of the bus bar board. When the connecting portion of the bus bar terminal extends outwardly beyond the base terminal portion in a direction of its width, the bus bar terminal may be deformed in a cross direction when being pulled down due to frictional engagement with the opposite terminal. Deformation or distortion of the bus bar terminal can be prevented by providing the terminal holder for the aforementioned bus bar terminal.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
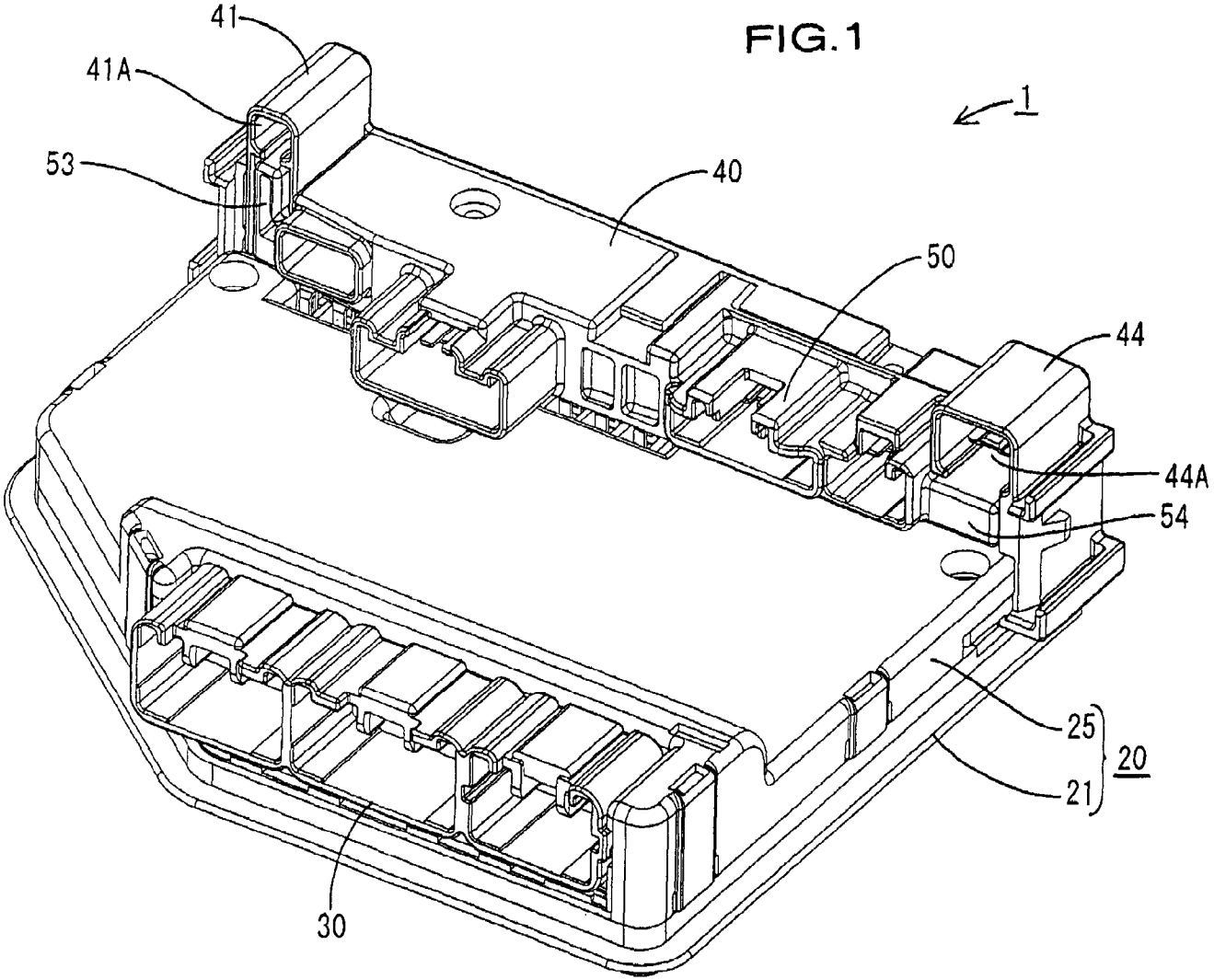
FIG. 1 is a perspective view of an electric junction box according to an embodiment of the present invention.
Figure 2:
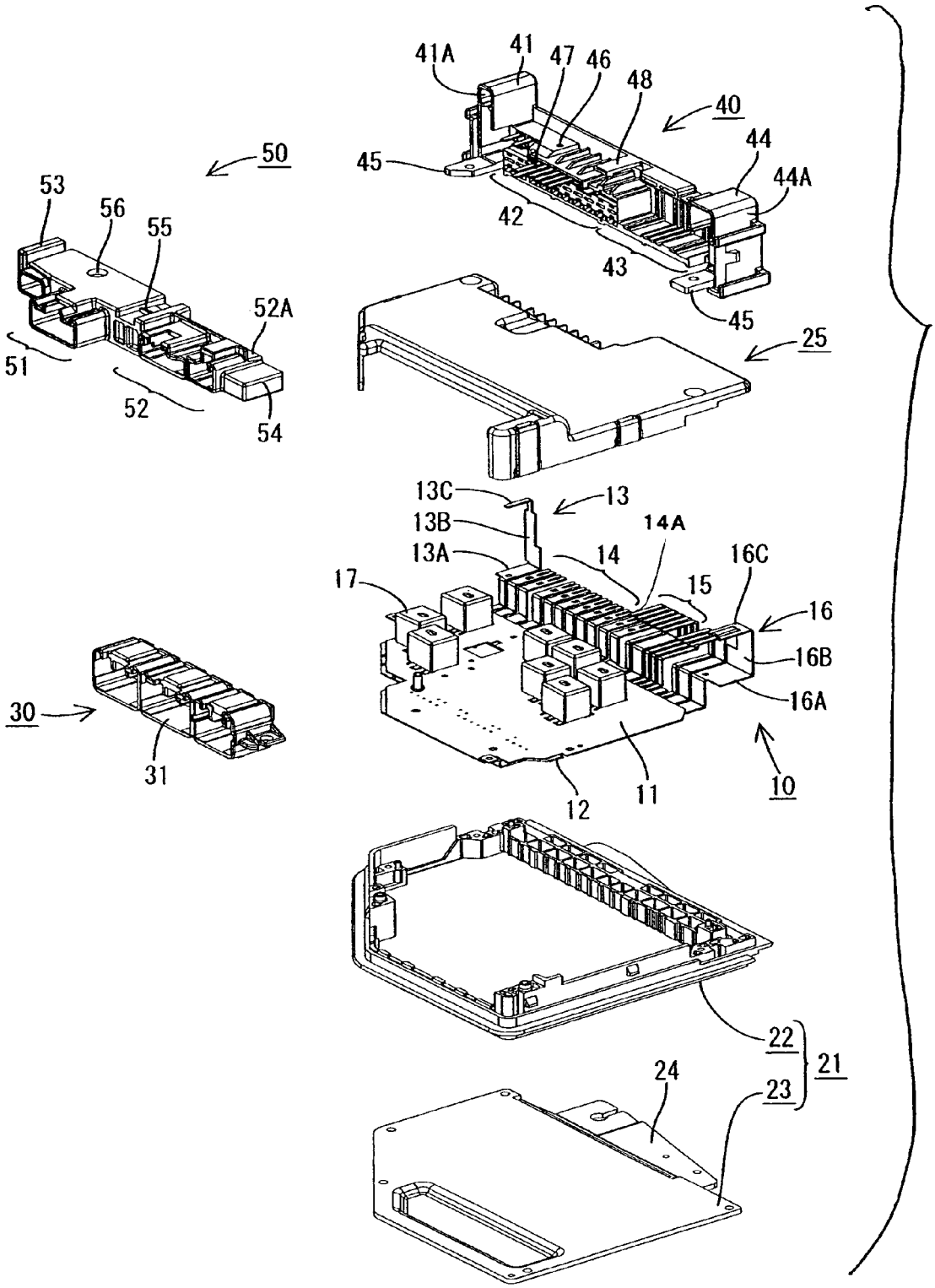
FIG. 2 is an exploded perspective view of the electric junction box of FIG. 1.
Figure 3:
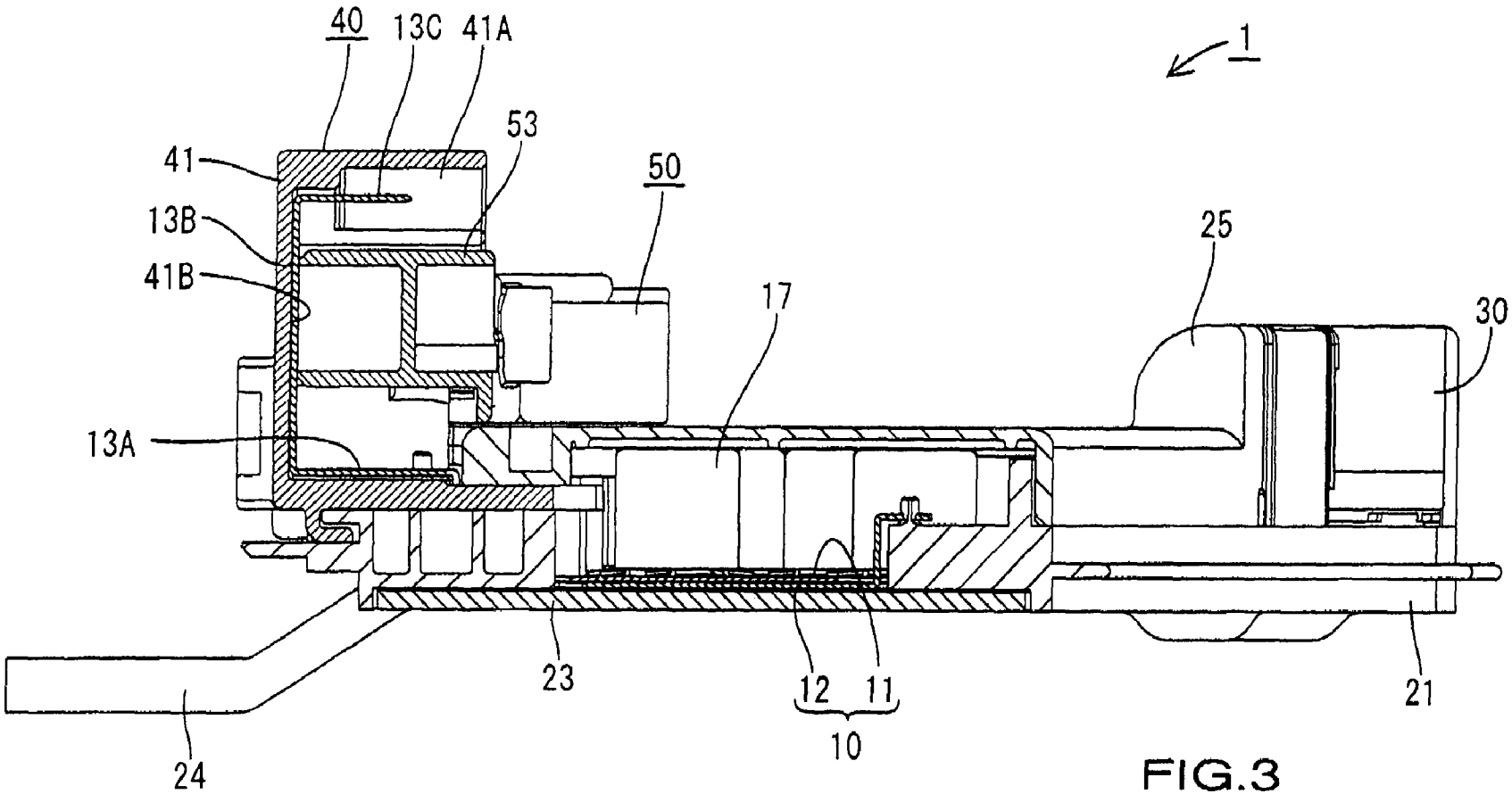
FIG. 3 is a partial cross sectional oblique view of the electric junction box when viewed from a left direction in FIG. 1.
Figure 4:
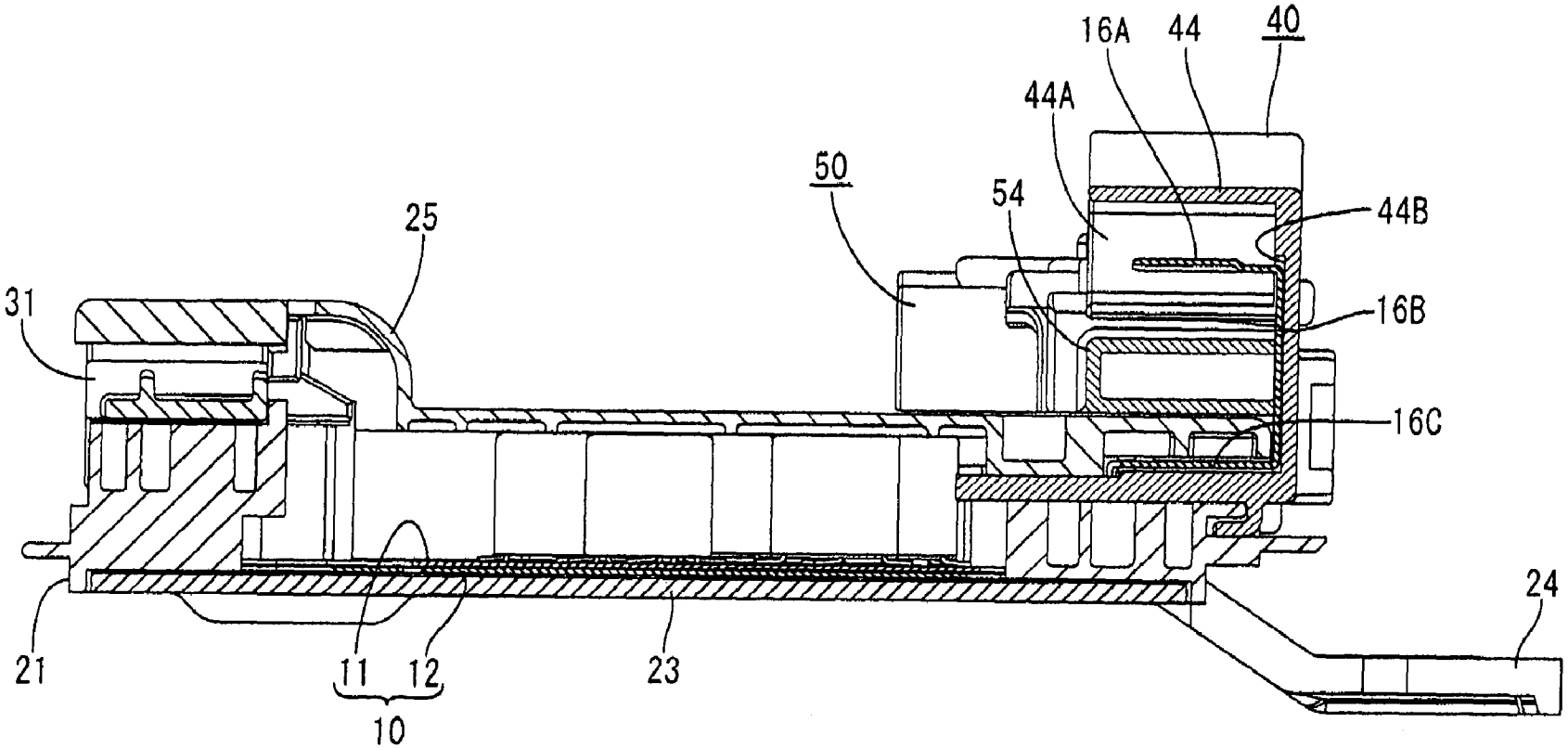
FIG. 4 is a partial cross sectional oblique view of the electric junction box when viewed from a right direction in FIG. 1.

FIG. 1 is an oblique perspective view of electric junction box 1 according to an embodiment of the present invention. FIG. 2 is an exploded oblique perspective view of electric junction box 1. In electric junction box 1, circuit component 10, which includes control circuit board 11 and bus bar board 12, and fuse box 40 are accommodated in case 20. In the present invention, fuse box 40 constitutes a first housing unit. Further, upper connector 50 is attached to fuse box 40. In the present invention, upper connector 50 constitues a second housing unit. The following illustrates respective components with the left front in FIG. 2 indicating a forward direction and the right rear in FIG. 2 indicating a rearward direction.

As shown in FIG. 2, circuit component 10 includes control circuit board 11 and bus bar board 12, which is mounted on an under surface of control circuit board 11. Electric components 17 such as for example, a relay, may be mounted on an upper surface of control circuit board 11.

As shown in FIG. 2, control circuit board 11 has a generally planar rectangular shape, having an outer edge with a left front corner removed. Conductor patterns (not shown) are formed on the upper surface of control circuit board 11. Bus bar board 12 is attached to the under surface of control circuit board 11 through a thin insulation adhesive material such as, for example a sheet.

Bus bar board 12 may be formed by stamping from a highly conductive metal plate. Bus bar board 12 forms a predetermined conductive circuit serving as a power circuit, and has an outer shape that substantially corresponds to that of the control circuit board 11. A plurality of bus bar terminals 13,14,15 and 16 project from a rear rim of bus bar board 12 and are arranged side by side in parallel. Bus bar terminals 13 and 16 are positioned at both ends of the bus bar board and extend rearward from a rear rim of control circuit board 11 for a predetermined length and turn upward at a 90-degree angle therefrom. Further, bus bar terminals 13 and 16 have connecting portions 13A and 16A extending rearward therefrom. Bus bar terminals 13 and 16 further have relay portions 13B and 16B extending upward from the rear ends of the connecting portions 13A and 16A. Bus bar terminals 13 and 16 also have connector joints 13C and 16C extending forward from the ends of relay portions 13B and 16B. In the present invention, connector joints 13C and 16C also constitute connecting portions.

Among the other bus bar terminals, bus bar terminals 14, positioned on a substantially left half portion of the bus bar board 12, excluding the leftmost terminal; extend rearward from the rear rim of control circuit board 11 for a predetermined length and turn upward at a 90-degree angle therefrom. Further, bus bar terminals 14 have fuse connectors 14A extending rearward therefrom. Tips of fuse connectors 14A have slits for fuse insertion. Bus bar terminals 15 positioned on a substantially right half portion of the bus bar board 12 excluding the rightmost terminal; extend rearward from the rear rim of control circuit board 11 for a predetermined length and turn upward at a 90-degree angle therefrom with their tips being bent over toward the front. Relay portions 13B and 16B and connector joints 13C and 16C of bus bar terminals 13 and 16 are positioned at both ends and have greater heights than those of bus bar terminals 15 positioned in between.

The leftmost bus bar terminal 13 has a connecting portion 13A and a relay portion 13B. The connecting portion 13A and a lower half of the relay portion 13B have a width greater than that of a base terminal portion, thus extending beyond the base terminal portion to the left. An upper half of the relay portion 13B has a width smaller than that of its lower half and is positioned to the left. The connector joint 13C, which is slightly thinner than relay portion 13B, extends from the end of the relay portion 13B. In this case, connector joint 13C is positioned farther to the left than the base terminal portion of bus bar terminal 13. Similarly, the rightmost bus bar terminal 16 has a width greater than that of the base terminal portion, thus extending beyond the base terminal portion to the right. An upper half of the relay portion 16B has a smaller width than that of its lower half and is positioned to the right. The connector joint 16C extends from the upper end of relay portion 16B and thus is positioned farther to the right than the base terminal portion of bus bar terminal 16.

Case 20 housing circuit component 10 includes lower case 21 and upper case 25; lower case 21 includes frame body 22 and heat sink 23, which may be attached from below frame body 22. Upper case 25 may be attached from above lower case 21.

Frame body 22 attached to lower case 21 may be made of an insulating material such as, for example, a synthetic resin and formed substantially along a periphery of circuit component 10. Frame body 22 may be formed to substantially fit circuit component 10 therein. Heat sink 23 is configured to release heat generated from electric components 17 mounted on circuit component 10. Heat sink 23 has a generally planar shape and is made of a metal material such as, for example, aluminum. Heat sink 23 is attached to frame body 22 so as to close an opening of an under surface of frame body 22. Further, heat sink 23 may be adhered to an under surface of bus bar board 12 through an insulating adhesive material. A periphery of heat sink 23 may be attached from below such as by screws, fixing heat sink 23 to frame body 22. Attachment piece 24 extends toward the outside of the case from a rear end edge of heat sink 23. Electric junction box 1 may be installed on a vehicle panel via attachment piece 24 when in use.

Upper case 25 may be made of a synthetic resin material and attached to lower case 21, covering an upper side of circuit component 10. Both front and rear sides of upper case 25 have openings into which PCB connector 30 and fuse box 40 are received in a manner to close the openings. PCB connector 30 attached to the front side of upper case 25 includes housing 31, which may be made of a synthetic resin material. Housing 31 is long in the lateral direction and has an opening in the front. Terminals connected to circuit component 10 may be housed within housing 31, although their detailed illustrations are not provided in the drawings.

Fuse box 40 attached to a rear end side of upper case 25 may be made of a synthetic resin material and covers substantially the entire length of the rear end side of upper case 25. Fuse box 40 is elongated in the lateral direction and its upper half portion extends upward from an upper end edge of upper case 25. Fuse box 40 is provided with connectors 41 and 44 on both of its ends in a length wise direction. In the present invention, connectors 41 and 44 constitute receiving portions. Connectors 41 and 44 have greater heights than other portions and have openings in the front. Fuse connecting portions 42 are provided between connectors 41 and 44 on a left side of the fuse box and terminal receptacles 43 are provided between connectors 41 and 44 on a right side of the fuse box. Connectors 41 and 44 have sidewalls on both inner and outer sides. The sidewalls on the inner sides have their lower half portions removed, providing a space opening toward the inside (toward terminal receptacles 43 and fuse connecting portions 42). Further, connectors 41 and 44 have hood portions 41A and 44A in their upper portions. Hood portions 41A and 44A are configured to receive opposite terminals of an opposite connector.

Attachment pieces 45 for fixing fuse box 40 to case 20 are formed around lower edge portions of the right and left sidewalls of fuse box 40. Attachment pieces 45 slightly extend inward with their front ends extending forward. Attachment pieces 45 are attached, such as by screws from above upper case 25 while being clamped between the rear end edge of upper case 25 and frame body 22, thereby fixing fuse box 40 and upper case 25 to frame body 22.

Fuse connecting portions 42 have a plurality of attachment holes to which fuses (not shown) are attached. The plurality of attachment holes have openings on the rear sides. Bus bar terminals 14 have their ends facing the rear allowing them to be pressed into lower portions of the attachment holes from the front. Similarly, tube shaped connection terminals 47 are configured to engage bus bar terminals 14 and are pressed into upper portions of the attachment holes. Further, the bent-over portions of bus bar terminals 15 have their ends facing the front and are collectively housed in terminal receptacles 43. Similarly, the bent-over portions of bus bar terminals 13 and 16 have their ends facing the front and are housed in connectors 41 and 44; connectors 13A and 16A are housed along bottom walls of connectors 41 and 44; and relay portions 13B and 16B are housed along back walls 41B and 44B of connectors 41 and 44. Attachment pieces 45 of fuse box 40 extend forward from below the outwardly extending portions of connecting portions 13A and 16A of bus bar terminals 13 and 16.

Locking piece 48 is provided in a substantially central region of an upper side of fuse box 40 in a direction of its width. Locking piece 48 is configured to secure fuse box 40 to upper connector 50, which is described later, and is provided in a manner allowing locking piece 48 to bend upward and downward. A front end of locking piece 48 has a tip claw portion projecting downward. Further, a screw hole 46 is formed on an upper surface of fuse attachment 42 for attaching upper connector 50, which is described later.

Upper connector 50 is attached to an area extending toward the front side of upper case 25. Upper connector 50 is elongated in the lateral direction and extends along the width direction of fuse box 40. Further, a first hood portion 51 is positioned opposite to fuse connecting portions 42 and a second hood portion 52 is positioned opposite to terminal receptacles 43. These hood portions 51 and 52 may be in any suitable shape, and in the present embodiment are cylindrically shaped. Connection terminals 47 and bus bar terminals 15 project from fuse connecting portions 42 and terminal receptacles 43 of fuse box 40 respectively to the front and are inserted from the back, while opposite connectors (not shown) are received into hood portions 51 and 52 from the front.

Upper connector 50 has terminal holders 53 and 54 on both its ends. Terminal holder 53 is positioned on the left side and extends from a lateral lower side to the left side and further extends upward from the left end forming a generally L shaped cross-section. Similarly, terminal holder 54 is positioned on the right side and extends from a right lateral side to the right side forming a generally block shape. The upper end edges of terminal holders 53 and 54 reach lower end edges of hood portions 41A and 44A. Terminal holders 53 and 54 are received into a space between the bottom surfaces of connectors 41 and 44 and the lower end edges of hood portions 41A and 44A with substantially no gap therebetween.

Locking receiver 55 extends upward from a substantially central region of the upper surface of upper connector 50 along its width direction and is configured to receive the tip claw portion of locking piece 48 provided on the aforementioned fuse box 40. Further, screw hole 56 is formed on an upper surface of the first hood portion 51 in such a position as to correspond to screw hole 46 of fuse box 40. Upper connector 50 is removably attached to fuse box 40 by elastically attaching locking receiver 55 to the tip claw portion of locking piece 48 of fuse box 40. Upper connector 50 is further secured by attaching screws in screw holes 46 and 56.

The following describes operations and effects of the aforementioned embodiment.

When connected to fuse box 40, upper connector 50 is pressed into fuse box 40 in a manner that allows fuse connecting portions 42 to be received in the first hood portion 51 and allows terminal receptacles 43 to be received in the second hood portion 52. In this configuration bus bar terminals 14 and connection terminals 47 on the side of fuse connecting portions 42 are inserted into the first hood portion 51; bus bar terminals 15 on the side of terminal receptacles 43 are inserted into the second hood portion 52. At the same time, terminal holders 53 and 54 on both ends of upper connector 50 are inserted into connectors 41 and 44 respectively from the front.

When upper connector 50 reaches a predetermined assembling position, the rear end edges of terminal holders 53 and 54 reach rear walls 41B and 44B of connectors 41 and 44. Terminal holders 53 and 54 thus clamp relay portions 13B and 16B of bus bar terminals 13 and 16 against rear walls 41B and 44B and support them therebetween. Further, rear end side 52A of the second hood portion 52 also serves as a terminal holder by clamping bus bar terminal 15 against the back wall of terminal receptacles 43.

An opposite connector (not shown) is received into upper connector 50 from the front, thereby connecting bus bar terminals 13, 15 and 16 and connection terminal 47 to opposite terminals provided in the opposite connector.

When the opposite connector is received into upper connector 50 and is released, for example, for maintenance needs, connector joints 13C and 16C of bus bar terminals 13 and 16 receive a push-and-pull force in rearward and forward directions due to frictional engagement with the opposite terminals. In this case, bus bar terminals 13 and 16 may have their bent-over portions displaced while moving rearward and forward due to the push-and-pull force, resulting in a shape greatly bent over from the rear to the front. However, both ends of upper connector 50 have terminal holders 53 and 54, which clamp relay portions 13B and 16B of bus bar terminals 13 and 16 against rear walls 41B and 44B of connectors 41 and 44 and support them therebetween. This configuration controls displacement of bus bar terminals 13 and 16 in rearward and forward directions.

Similarly, bus bar terminals 15 receive a push-and-pull force in rearward and forward directions due to frictional engagement with the opposite terminals. However, rear end side 52A of the second hood portion 52 clamps the bent-over portions of bus bar terminals 15 against the rear wall of terminal receptacle 43 and support them therebetween, thereby preventing displacement of bus bar terminals 15 in rearward and forward directions.

In the aforementioned embodiment, upper connector 50 attached to fuse box 40 has terminal holders 53 and 54, which can support relay portions 13B and 16B of bus bar terminals 13 and 16 from the front, that is, an opposite side of a receiving direction to the opposite connector. Such a structure provides a simple configuration that prevents bus bar terminals 13 and 16 from being pulled down when being received into and released from the opposite connector. Also, relay portions 13B and 16B are clamped between the rear end sides of terminal holders 53 and 54 and rear walls 41B and 44B of connectors 41 and 44. In this configuration, movement along a receiving direction of relay portions 13B and 16B to the opposite connector are completely controlled, thereby making it possible to reliably prevent bus bar terminals 13 and 16 from being displaced.

Further, terminal holders 53 and 54 support substantially the entire widths of bus bar terminals 13 and 16. This configuration allows terminal holders 53 and 54 to hold bus bar terminals 13 and 16 evenly in a direction along their width, thereby making it possible to reliably prevent bus bar terminals 13 and 16 from being deformed.

In addition, the ends of bus bar terminals 13 and 16 include the base terminal portions connected to bus bar board 12 and connector joints 13C and 16C, which extend outwardly beyond the base terminal portions in the direction of its width. In such a configuration, bus bar terminals 13 and 16 are likely to be displaced in an oblique direction and significantly deformed due to frictional engagement with the opposite terminals. Such significant deformation can be avoided by providing bus bar terminals 13 and 16 with terminal holders 53 and 54.

The present invention is not limited to the embodiment explained above with reference to the drawings. Embodiments described below, for example, are also within the technical scope of the present invention. Further to the embodiments below, modified embodiments without departing from the essence of the present invention are possible.

Modifications of the first embodiment of the present invention are described below. In this regard, in the first embodiment, the housing units are formed as separate parts. However, in a modification of the first embodiment of the present invention, the housing units can be formed integrally and in one piece with the case.

Further, in the aforementioned embodiment, terminal holders 53 and 54 are provided for bus bar terminals 13 and 16, which have bent-over portions. However, in a further modification of the aforementioned embodiment, a shape of a bus bar terminal to be supported by a terminal holder is not limited to the aforementioned shape. A terminal holder may be provided, for example, for a crank-like bus bar terminal.

Further, in the above-noted embodiment, terminal holders 53 and 54 support substantially the entire widths of bus bar terminals 13 and 16. However, in a modification of the aforementioned embodiment, terminal holders 53 and 54 may have smaller widths to those of bus bar terminals 13 and 16.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. An electric junction box comprising:

a circuit component including a bus bar board;

a case housing said circuit component;

a first housing unit provided in said case, including a receiving portion, configured to engage an opposite connector;

at least one bus bar terminal including a relay portion and a connecting portion, said bus bar terminal received in said receiving portion such that said relay portion extends in a direction transverse to a receiving direction and said connecting portion extends in a direction substantially parallel to said receiving direction; and a second housing unit including a terminal holder configured to attach to said first housing unit such that said terminal holder supports said relay portion from a side opposite the receiving direction.

2. The electric junction box according to claim 1, wherein said relay portion is mounted to said bus bar board.

3. The electric junction box according to claim 2, wherein said connecting portion extends from the end of said relay portion in said receiving direction.

4. The electric junction box according to claim 2, including a connector joint, which is slightly thinner than said relay portion.

5. The electric junction box according to claim 1, wherein said connecting portion extends from the end of said relay portion in said receiving direction.

6. The electric junction box according to claim 1, wherein a locking piece is provided in a substantially central region of said first housing unit.

7. The electric junction box according to claim 6, wherein said locking piece has a tip claw portion projecting downward.

8. The electric junction box according to claim 6, wherein a locking receiver is provided in a substantially central region of said second housing unit and is configured to engage said locking piece of said first housing unit.

9. The electric junction box according to claim 8, wherein said locking receiver extends upward.

10. The electric junction box according to claim 6, wherein said first housing unit is formed integrally and in one piece with said case.

11. The electric junction box according to claim 1, wherein said relay portion extends along a rear wall of said receiving portion, and said terminal holder secures said relay portion against the rear wall of said receiving portion such that said relay portion is supported therebetween.

12. The electric junction box according to claim 11 wherein said bus bar terminal includes a base terminal portion and said connecting portion, said base terminal portion being connected to said bus bar board, and said connecting portion extending outwardly beyond the base terminal portion in a width direction of said bus bar board.

13. The electric junction box according to claim 1 wherein said bus bar terminal includes a base terminal portion and said connecting portion, said base terminal portion being connected to said bus bar board, and said connecting portion extending outwardly beyond the base terminal portion in a width direction of said bus bar board.

14. The electric junction box according to claim 1, wherein said terminal holder extends substantially the entire width of said at least one bus bar terminal.

15. The electric junction box according to claim 1, wherein said case includes an upper case, a lower case and a heat sink.

16. The electric junction box according to claim 15, wherein said lower case is made of an insulating material.

17. The electric junction box according to claim 16, wherein said insulating material comprises a synthetic resin material.

18. The electric junction box according to claim 15, wherein said heat sink is formed of a metal material.

19. The electric junction box according to claim 18, wherein said metal material comprises aluminum.

20. The electric junction box according to claim 15, wherein said lower case includes a frame body and said heat sink closes an opening of an under surface of said frame body.

* * * * *